US005586514A

United States Patent [19]

Yuscavage

[11] Patent Number: 5,586,514

[45] Date of Patent: Dec. 24, 1996

[54] MOORING DEVICE

[76] Inventor: Thomas M. Yuscavage, 149 Bear Creek Rd., Dupont, Pa. 18641

[21] Appl. No.: 413,076

[22] Filed: Mar. 29, 1995

[51] Int. Cl.[6] ..... B63B 21/00

[52] U.S. Cl. ..... 114/230; 114/221 R

[58] Field of Search ..... 119/801–804; 43/87; 114/230, 293, 294, 221 R; 294/19.1, 90

[56] References Cited

U.S. PATENT DOCUMENTS

| | | | |
|---|---|---|---|
| 1,569,496 | 6/1925 | Johnson | 119/803 |
| 3,224,404 | 12/1965 | De Jong | 114/230 |
| 3,319,609 | 5/1967 | Pickard et al. | 119/804 |
| 3,841,685 | 10/1974 | Kolodziej | 294/19 R |
| 3,878,808 | 4/1975 | Mock, Jr. | 114/230 |
| 3,945,335 | 3/1976 | Kratz | 114/221 |
| 4,099,750 | 7/1978 | McGrew | 289/1.5 |
| 4,506,472 | 3/1985 | Barman | 119/803 |
| 4,519,643 | 5/1985 | Harris | 294/19.1 |
| 4,596,530 | 6/1986 | McGlinn | 441/80 |
| 5,282,825 | 2/1994 | Muck et al. | 294/19.1 |
| 5,398,634 | 3/1995 | Eagan | 114/221 R |

FOREIGN PATENT DOCUMENTS

| | | | |
|---|---|---|---|
| 878735 | 10/1961 | United Kingdom | 119/803 |

*Primary Examiner*—Edwin L. Swinehart
*Attorney, Agent, or Firm*—Nies, Kurz, Bergert & Tamburro

[57] ABSTRACT

A mooring device for securing a boat to a pole or other element at a mooring dock. The device includes an elongated tubular handle having attached at one end a flexible tubular piece which is looped back upon itself. A continuous mooring line or rope has one end which extends into the back end of the tubular handle, through the handle and tubular loop, back through the handle and out of the open back end where it is knotted with the other trailing end of the rope to form a loop at the back end. The trailing end of the rope may extend a predetermined length from the back end of the handle and, at its terminal end, may be looped back upon itself to form another attachment loop. The rope is pulled fight within the handle and the flexible tubular piece so that the loop at the front of the handle is retained in an open condition, laterally displaced from the handle, and the load or tensile forces tying the boat to the dock post are borne by the rope itself.

6 Claims, 2 Drawing Sheets

MOORING DEVICE

BACKGROUND OF THE INVENTION

This invention relates generally to mooring devices for securing a boat to a pole or other element at a dock, and more particularly, to a novel dock-looper device which is easy and convenient to handle and enables a boater to quickly park and secure a boat adjacent a dock.

Operators of small pleasure boats are often faced with the task of safely and easily bringing their boats to a stop adjacent a dock and then tying the boat to the dock with suitable dock lines or ropes. In the past, a boater often had to cast or throw a loose line to a person on the dock or attempt to throw a loop formed at the end of the line around a post or piling in order to secure the boat to the dock. As an alternative, some boats are supplied with boat hooks with which a person can grapple for a post while at the same time attempt to keep the boat from smashing against the post. These prior methods are unreliable and often result in damage to a person's boat or to other boats which may be docked nearby.

Various prior art devices have been suggested to assist in securing a boat to a post or piling such as the mooring devices illustrated in prior U.S. Pat. Nos. 3,224,404, 3,841,685, 3,878,808, 3,945,335, and 4,519,643. However, each of those devices suffers from inherent structural and functional disadvantages and, to applicant's knowledge, none of those has been successfully commercially adopted by the boating trade.

SUMMARY OF THE INVENTION

Accordingly, the primary object of this invention is to provide a novel boat mooring device by which a deck hand may quickly and easily secure a boat to a post or piling at a dock, while at the same time, avoiding any damage to the boat.

Another object of the invention is to provide the above novel mooring device which is easy to manufacture and is readily affordable to boat owners.

Still another object of the invention to provide the above novel mooring device which is constructed of readily available materials that are assembled together in a way that enhances the reliability and durability of the device, while at the same time reducing its manufacturing costs.

Another object of the invention is to provide the above novel mooring device which comprises an elongated tubular handle having attached at one end a smaller flexible tube looped back upon itself. The device also includes a continuous mooring line or rope having one end which extends into the back end of the tubular handle, through the tubular loop, back through the handle and out the back end where it is again knotted with the other end of the rope to form a loop at the back end. The other end of the rope may extend a predetermined length beyond the back end of the handle and at its terminal end be looped back upon itself to form another attachment loop. The larger loop at the front end of the handle is retained in an open condition by the flexible tube so that it may be readily placed over a post adjacent the dock. The smaller rope loop which is knotted at the back end of the handle may be readily attached to a cleat or other object on the boat to secure the boat to the dock post. The loop which is provided at the end of the rope may be secured to another cleat on the boat if necessary.

Other objects and advantages will become readily apparent from reading the following detailed description of the invention wherein reference is made to the accompanying drawings.

Figure 1:
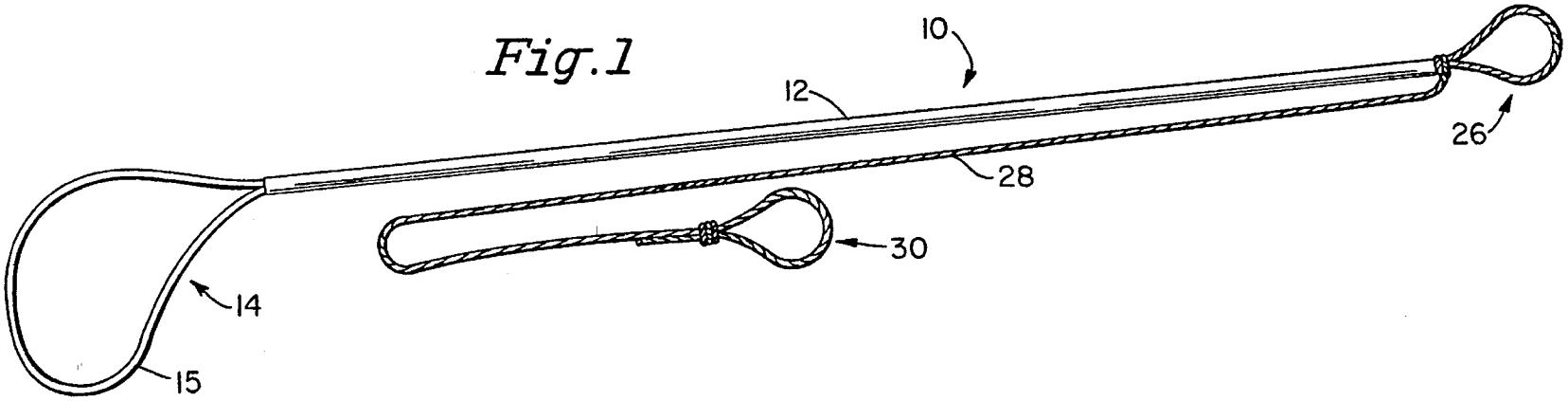
FIG. 1 is a generally perspective view of the novel mooring device of the invention.

DETAILED DESCRIPTION OF THE INVENTION:

Referring now to the drawings, the mooring device 10 comprises an elongated tubular handle 12 preferably formed from relatively rigid one half inch plastic (PVC) pipe (⅞" o.d.×11/16" i.d.), and a large loop 14 formed by bending a length of flexible polyethylene plastic tubing 15 (½" o.d.× ⅜"i.d.) back on itself and gluing the ends 16 and 18 of the tubing at 19 into the front open end of handle 12. A leading end 20 of a continuous, one-piece ¼" diameter rope 22 passes through the rear open end 24 of handle 12, through open end 16 of tubing 15 around the loop 14 back through open end 18, back through handle 12 to open end 24 where it is slip-knotted and tied together at 23 with line 22 in such a way as to form a smaller loop 26 at the rear end of handle 12. The knotting prevents the rope from being pulled through the rear end of handle 12. The other trailing end 28 of line 22 slips through knot 23 and extends a predetermined length from handle end 24 and is bent back and tied upon itself at its terminal end to form another end loop 30 spaced a substantial distance from the rear end 24 of handle 12.

The parts are assembled by first passing end 20 of rope 22 through the small plastic tubing 15, then bending tubing 15 into a loop and then passing both ends 20 and 28 back through handle 12 until they extend through open end 24. Open ends 16 and 18 of tubing 14 are then inserted about ¾ of an inch into the front open end of handle 12 and the ends 16 and 18 are glued in place onto handle 12.

Figure 2:
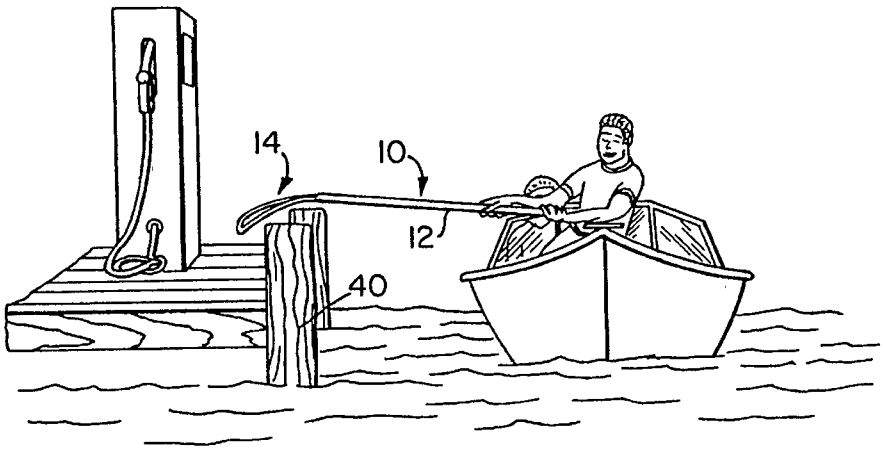
FIG. 2 is a fragmentary perspective view illustrating a boat approaching a dock and a deck hand about to place the large loop of the mooring device over a dock post.

End 20 is then bent back on itself to form loop 26 and then knotted at 23 around end 28 so that it cannot be pulled back through handle 12. End 28 is then pulled tight so that rope 22 bears against the inside surface of tubing 15 and slightly bends the tubing laterally downwardly away from the axis of handle 12 (FIGS. 1 & 2). Next, the terminal end of length 28 is then bent back and knotted upon itself to form the end loop 30.

Figure 3:
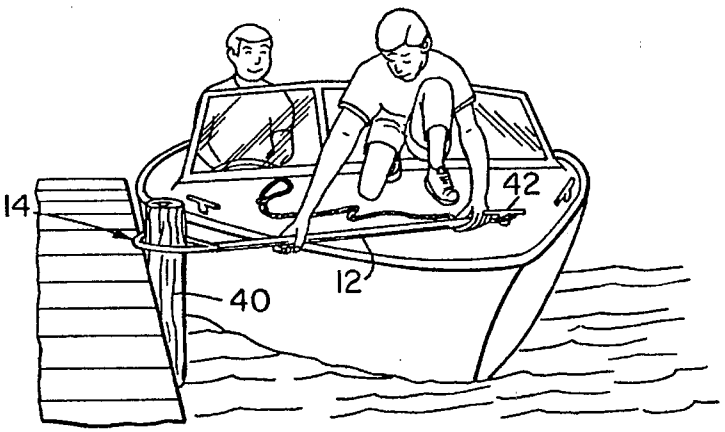
FIG. 3 is a view similar to FIG. 2 illustrating the large loop in place on a dock post and the small loop at the rear of the handle tied to a cleat on the boat.
Figure 4:
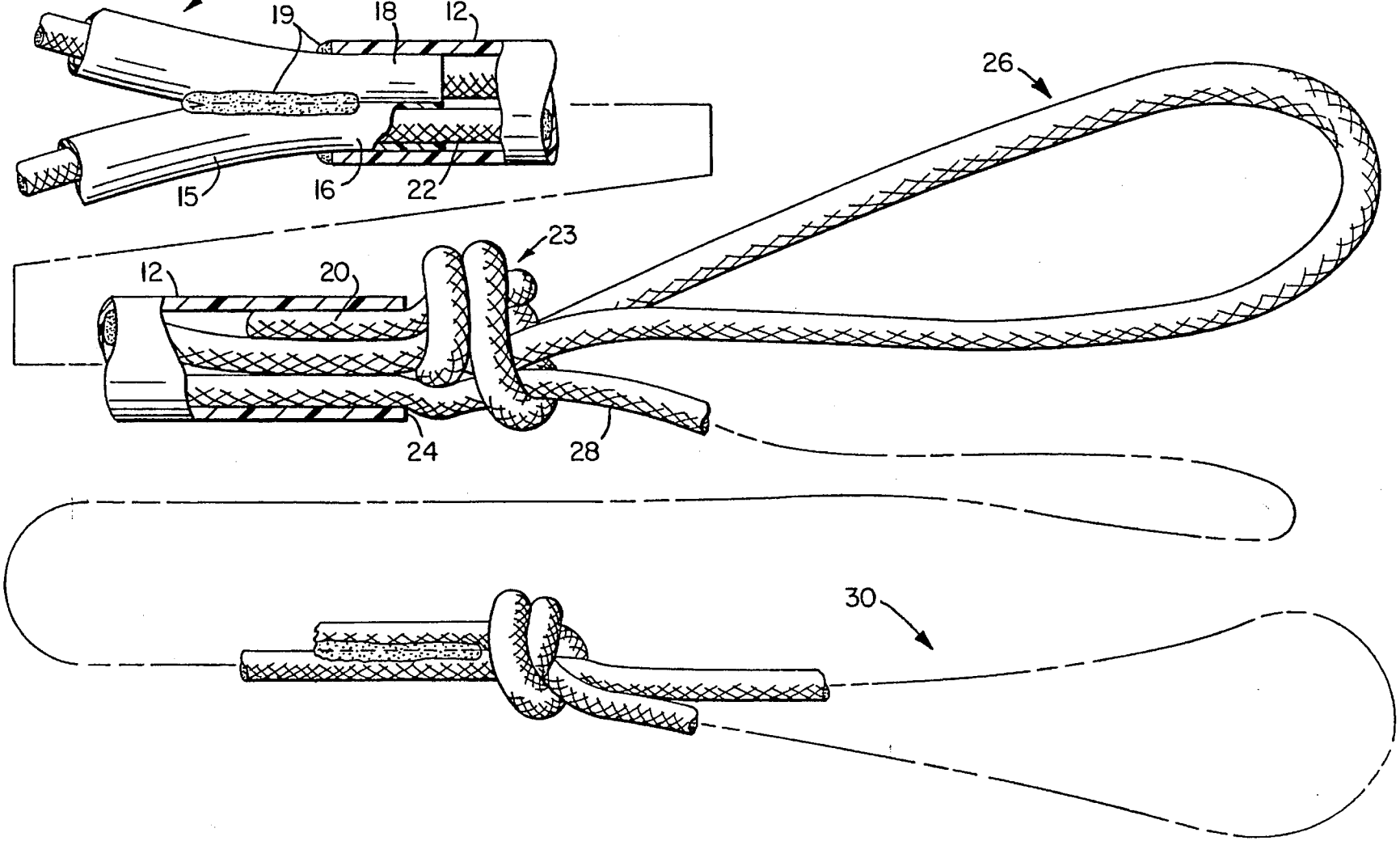
FIG. 4 is a fragmentary sectional perspective view generally illustrating the manner in which the various components of the mooring device are attached together to form the various loops.

As illustrated in FIGS. 2 & 3, the device 10 permits a deck hand to easily and conveniently tie a boat adjacent the dock. The deck hand grasps the handle 12 and places loop 14 in the downwardly bent position to easily slide loop 14 over a dock post 40. Tubing 15, although it is flexible, has sufficient stiffness and rigidity to retain the rope 22 therein in a wide open loop condition so as to readily pass over the top of post 40. This is also facilitated by the fact that tubing 15 is bent laterally from the axis of handle 12 by pulling the rope 22 tight during assembly as described above. Once loop 14 is attached to post 40, the loop 26 at the rear end 24 of handle 12 may be readily attached to a cleat 42 on the boat itself. Thus the boat is secured quickly and easily to the dock without damaging the boat, the dock or any nearby boats.

Also, because the rope end 28 is pulled tight during assembly and then securely knotted at 23 at the rear end 24 of handle 12, the tensile forces acting between loop 14 and loop 26 are borne only by rope 22 and not by the stiffening tubing 15. Consequently, there are substantially no forces acting upon the glued joint formed by the front end of handle 12 and the ends 16 and 18 of tube 15 which would tend to pull the tube 15 away from the handle.

If need be, the additional loop 30 at the terminal end of rope length 28 may be tied to another cleat on the boat or to a cleat or other fastener on the dock. In some instances, it may be desirable or necessary to use only loops 14 and 30 in securing the boat to the dock.

It is apparent that the mooring device 10 as described above accomplishes the objectives initially set forth in providing a device which is reliable, durable and versatile in use and yet is very economical to manufacture. The flexible but yet stiffening tubing 15 which is part of the loop 14 at the front end of handle 12 retains the rope in a wide open condition to facilitate attachment of the loop 14 to a dock post. The use of a continuous one piece rope 22 bent back and tied upon itself to form the loops 14, 26, and 30 greatly simplifies the construction of the device 10 and substantially reduces cost, thus making it affordable to the average boat owner.

The device is also a very versatile tool to have on board a boat, since it may be used as illustrated in FIG. 1 to secure the boat to the dock, or may be used simply as a rope, for example, by employing loops 26 and 30 together or selectively with loop 14 for securing loose objects on the boat to the boat itself.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A mooring device comprising an elongated tubular handle having forward and rearward open ends;

flexible tubular means formed into a loop having opposite ends connected to the forward end of said handle;

a continuous line having leading and trailing ends, said leading end extending into said rearward end, through said handle, through said flexible tubular means to form said first loop therewith, through said handle and out of said rearward end, said leading and trailing ends of said line being tied at said rearward end of said handle to form a second loop.

2. The mooring device of claim 1, said tubular means having sufficient stiffness to normally maintain said first loop in an open condition.

3. The mooring device of claim 2, wherein said line is pulled tight to normally maintain said loop in a laterally bent position with respect to said handle.

4. The mooring device of claim 3, wherein the trailing end of said line includes a length which extends substantially beyond the rearward end of said handle and the terminal end of said length is formed into a third loop.

5. The mooring device of claim 1, wherein the trailing end of said line includes a length which extends beyond the rearward end of said handle, and the terminal end of said length is formed into a third loop.

6. The mooring device of claim 1, said handle being constructed of relatively rigid tubular plastic material and said tubular means being constructed of flexible plastic material.

* * * * *